US011293450B2

(12) United States Patent
Byon et al.

(10) Patent No.: US 11,293,450 B2
(45) Date of Patent: Apr. 5, 2022

(54) CENTRIFUGAL COMPRESSOR

(71) Applicant: IHI Corporation, Tokyo (JP)

(72) Inventors: Jinhee Byon, Tokyo (JP); Takehiko Kato, Tokyo (JP)

( * ) Notice: Subject to any disclaimer, the term of this patent is extended or adjusted under 35 U.S.C. 154(b) by 0 days.

(21) Appl. No.: 16/952,081

(22) Filed: Nov. 19, 2020

(65) Prior Publication Data

US 2021/0071678 A1 Mar. 11, 2021

Related U.S. Application Data

(63) Continuation of application No. PCT/JP2019/014536, filed on Apr. 1, 2019.

(30) Foreign Application Priority Data

May 25, 2018 (JP) ..... JP2018-100294

(51) Int. Cl.
*F04D 29/08* (2006.01)
*F04D 29/063* (2006.01)
(Continued)

(52) U.S. Cl.
CPC ..... *F04D 29/083* (2013.01); *F04D 29/063* (2013.01); *F04D 29/284* (2013.01); *F04D 29/4206* (2013.01); *F04D 29/44* (2013.01)

(58) Field of Classification Search
CPC .... F04D 29/083; F04D 29/063; F04D 29/284; F04D 29/4206; F04D 29/44; F04D 29/441
See application file for complete search history.

(56) References Cited

U.S. PATENT DOCUMENTS 4,382,747 A * 5/1983 Okano ..... F01D 25/166 415/207
5,297,928 A * 3/1994 Imakiire ..... F04D 29/5846 415/112
(Continued)

FOREIGN PATENT DOCUMENTS

CA 1082150 7/1980
CN 105264236 1/2016
(Continued)

OTHER PUBLICATIONS

International Preliminary Report on Patentability with Written Opinion dated Dec. 10, 2020 for PCT/JP2019/014536.
(Continued)

*Primary Examiner* — Brian P Wolcott
(74) *Attorney, Agent, or Firm* — Soei Patent & Law Firm

(57) ABSTRACT

A centrifugal compressor includes an impeller which includes a front surface, a back surface, and a side surface; a first wall portion which includes a first wall surface facing the front surface and forming a flow passage; a second wall portion which includes a second wall surface facing the back surface and the first wall surface; and a protruding wall portion which is provided at an outside in a radial direction in relation to the side surface of the impeller. The protruding wall portion includes a third wall surface extending from the second wall surface in the axial direction and facing the side surface of the impeller. The third wall surface further extends toward the first wall surface in the axial direction from a connection portion between the front surface and the side surface. The third wall surface and the side surface form a second gap therebetween.

7 Claims, 3 Drawing Sheets

(51) Int. Cl.

| | |
|---|---|
| ***F04D 29/28*** | (2006.01) |
| ***F04D 29/42*** | (2006.01) |
| ***F04D 29/44*** | (2006.01) |

(56) References Cited

U.S. PATENT DOCUMENTS

| | | | | |
|---|---|---|---|---|
| 10,408,221 | B2 * | 9/2019 | Byon | F01D 5/048 |
| 10,876,535 | B2 * | 12/2020 | Nagao | F04D 17/122 |
| 2016/0084263 | A1 | 3/2016 | Morita | |
| 2017/0002826 | A1 | 1/2017 | Byon | |
| 2018/0238383 | A1 | 8/2018 | Nambu et al. | |

FOREIGN PATENT DOCUMENTS

| | | | |
|---|---|---|---|
| JP | S50-138410 | | 11/1975 |
| JP | S53-138206 | | 11/1978 |
| JP | S57-013435 | | 3/1982 |
| JP | H6-108867 | | 4/1994 |
| JP | H6108867 | * | 4/1994 |
| JP | H10-089291 | | 4/1998 |
| JP | 2009-019564 | | 1/2009 |
| JP | 2013-221454 | | 10/2013 |
| WO | 2015/174335 | | 11/2015 |
| WO | 2016/129039 | | 8/2016 |

OTHER PUBLICATIONS

International Search Report dated Jun. 18, 2019 for PCT/JP2019/014536.

* cited by examiner

CENTRIFUGAL COMPRESSOR

CROSS-REFERENCE TO RELATED APPLICATIONS

This application is a continuation application of PCT Application No. PCT/JP2019/014536, filed Apr. 1, 2019, which claims the benefit of priority from Japanese Patent Application No. 2018-100294, filed May 25, 2018, the entire contents of which are incorporated herein by reference.

BACKGROUND

International Publication No. 2016/129039 describes a centrifugal turbocharger which includes a rotation shaft, a compressor impeller fixed to one end of the rotation shaft, and a compressor housing accommodating the compressor impeller.

In such a centrifugal turbocharger, when the compressor impeller rotates, a working fluid is sucked into a flow passage inside the compressor housing to be compressed.

SUMMARY

In some centrifugal turbochargers, a negative pressure may be formed in a gap on a back surface side of the compressor impeller when the compressor impeller rotates.

Then, for example, there is concern that oil on the side of the rotation shaft is sucked by the negative pressure and leaks to the gap.

Here, the present disclosure describes example centrifugal compressors in which oil leakage is prevented.

An example centrifugal compressor includes an impeller which includes a main body including a front surface and a back surface facing opposite sides thereof in an axial direction and a side surface connected to the front surface and the back surface, a first wall portion which includes a first wall surface facing the front surface and forming a flow passage through which a working fluid flows together with the front surface, a second wall portion which includes a second wall surface facing the back surface and the first wall surface and forming a first gap together with the back surface, and a protruding wall portion which is provided at an outside in a radial direction in relation to the side surface of the impeller so as to protrude from the second wall surface toward the first wall surface. The protruding wall portion may include a third wall surface extending from the second wall surface in the axial direction and facing the side surface of the impeller. The third wall surface may further extend toward the first wall surface in the axial direction from a connection portion which connects the front surface and the side surface, and the third wall surface and the side surface may form a second gap therebetween. The second gap may fluidly couple the flow passage with the first gap.

DETAILED DESCRIPTION

Figure 1:
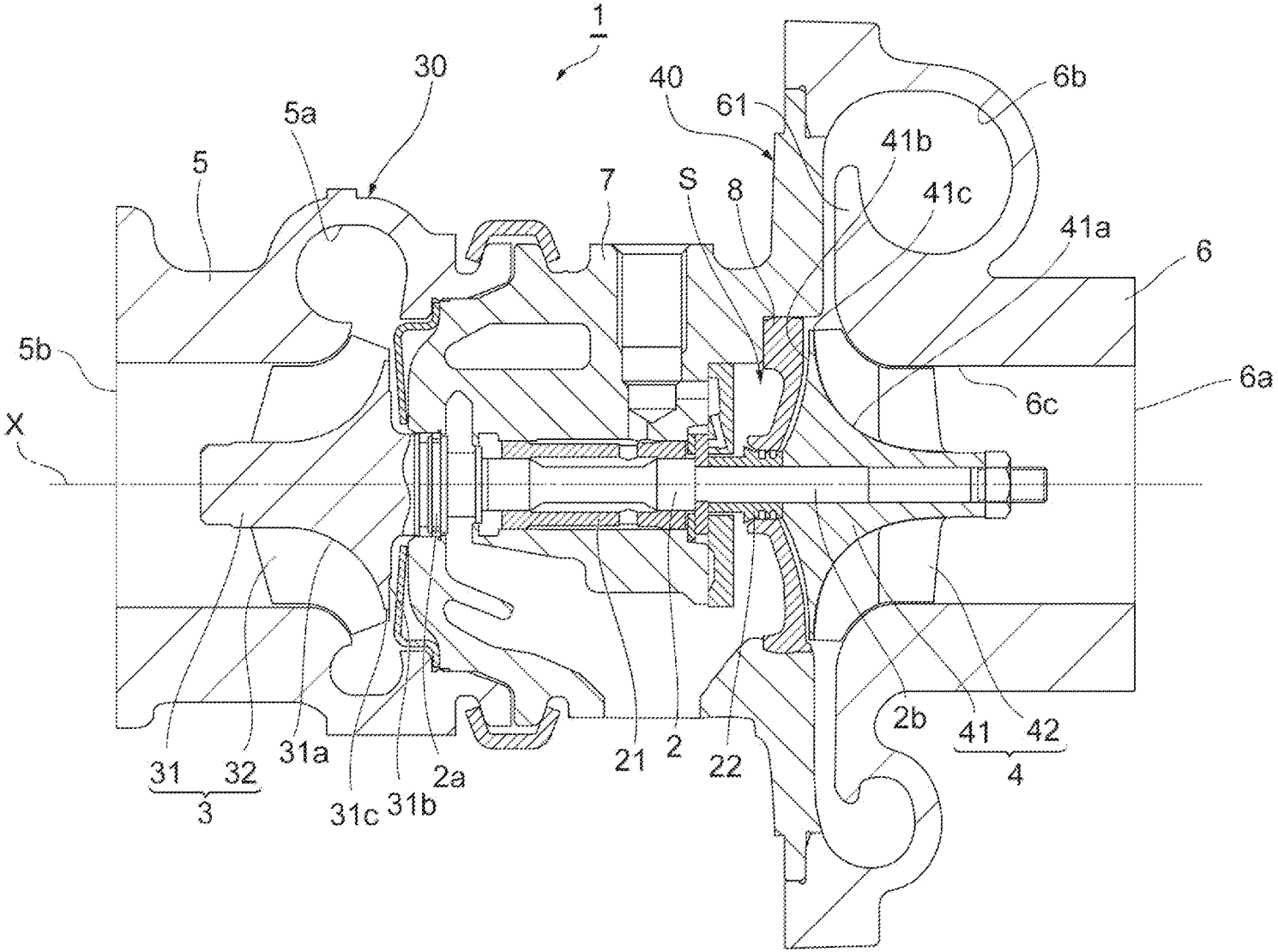
FIG. 1 is a cross-sectional view illustrating an example centrifugal compressor.

An example centrifugal compressor includes an impeller which includes a main body including a front surface and a back surface facing opposite sides thereof in an axial direction and a side surface connected to the front surface and the back surface, a first wall portion which includes a first wall surface facing the front surface and forming a flow passage through which a working fluid flows together with the front surface, a second wall portion which includes a second wall surface facing the back surface and the first wall surface and forming a first gap together with the back surface, and a protruding wall portion which is provided at an outside in a radial direction in relation to the side surface of the impeller so as to protrude from the second wall surface toward the first wall surface. The protruding wall portion may include a third wall surface extending from the second wall surface in the axial direction and facing the side surface of the impeller. The third wall surface may further extend toward the first wall surface in the axial direction from a connection portion which connects the front surface and the side surface, and the third wall surface and the side surface may form a second gap therebetween. The second gap may fluidly couple the flow passage with the first gap.

In the centrifugal compressor, when the impeller rotates around the axis, the working fluid flows through the flow passage to be compressed. The centrifugal compressor may include the protruding wall portion which is provided at the outside in the radial direction in relation to the side surface of the impeller so as to protrude from the second wall surface toward the first wall surface. The protruding wall portion may include the third wall surface which extends from the second wall surface in the axial direction and faces the side surface of the impeller. The third wall surface may further extend toward the first wall surface in the axial direction from the connection portion between the front surface and the side surface. The third wall surface and the side surface may form the second gap therebetween, which fluidly couples the flow passage with the first gap. In some examples, a part of the working fluid flowing through the flow passage along the front surface collides with the third wall surface and flows to the first gap through the second gap. Accordingly, a negative pressure is prevented from being formed in the first gap on the side of the back surface in the impeller and oil is prevented from being sucked into the first gap due to the negative pressure. Thus, the centrifugal compressor may prevent oil leakage.

In some examples, the third wall surface is fainted by one inner peripheral surface. Since the third wall surface is formed by one inner peripheral surface, a part of the working fluid flowing through the flow passage along the front surface collides with the third wall surface and smoothly flows to the first gap through the second gap. Accordingly, a negative pressure is reliably prevented from being formed in the first gap.

In some examples, the third wall surface includes two or more inner peripheral surfaces and a step portion formed between the inner peripheral surfaces. In this case, a degree of freedom in designing the protruding wall portion is improved.

In some examples, the centrifugal compressor includes a diffuser and a scroll which communicate with the flow passage, the protruding wall portion includes a fourth wall surface connected to the side opposite to the second wall surface in the third wall surface and facing the first wall surface, and the fourth wall surface extends in the radial direction to form the diffuser together with the first wall surface and is smoothly continuous to an inner wall surface forming the scroll. In this case, even in the centrifugal compressor with the protruding wall portion, desired compression efficiency can be obtained without deteriorating compression efficiency.

In the following description, with reference to the drawings, the same reference numbers are assigned to the same components or to similar components having the same function, and overlapping description is omitted. Further, in the present specification, the "radial direction" and the "circumferential direction" may be set based on a rotation axis X to be described later.

An example turbocharger will be described with reference to the turbocharger 1 illustrated in FIG. 1. The turbocharger (centrifugal compressor) 1 may be mounted on, for example, an internal combustion engine for an automobile. The turbocharger 1 includes a shaft 2 which extends along the rotation axis X and is rotatable around the rotation axis X, a turbine impeller 3 which is provided in a first end 2*a* of the shaft 2, and a compressor impeller (impeller) 4 which is provided in a second end 2*b* of the shaft 2. Further, the turbocharger 1 may include a turbine housing 5 which accommodates the turbine impeller 3, a compressor housing (first wall portion) 6 which accommodates the compressor impeller 4, and a bearing housing 7 which is disposed between the turbine housing 5 and the compressor housing 6 and accommodates the shaft 2.

The turbine impeller 3 includes a main body 31 and a plurality of blades 32. The main body 31 includes a front surface 31*a* and a back surface 31*b* which face the opposite sides thereof in the axial direction along the rotation axis X and a side surface 31*c* which is connected to the front surface 31*a* and the back surface 31*b*. The front surface 31*a* is a curved surface of which an outer diameter decreases from the back surface 31*b* toward the front surface 31*a*. The plurality of blades 32 are provided in the front surface 31*a*. The blade 32 is integrally formed with the main body 31. The turbine impeller 3 is fixed to the first end 2*a* of the shaft 2 so that the back surface 31*b* faces the shaft 2. The turbine housing 5 is provided with an inlet, a scroll 5*a* communicating with the inlet, and an outlet 5*b* communicating with the scroll 5*a*. The turbine impeller 3 and the turbine housing 5 constitute a turbine 30.

The compressor impeller 4 may include a main body 41 and a plurality of blades 42. The main body 41 may include a front surface 41*a* and a back surface 41*b* which face the opposite sides thereof in the axial direction along the rotation axis X and a side surface 41*c* which is connected to the front surface 41*a* and the back surface 41*b*. The front surface 41*a* may be a curved surface of which an outer diameter decreases from the back surface 41*b* toward the front surface 41*a*. The plurality of blades 42 are provided in the front surface 41*a*. The blade 42 is integrally formed with the main body 41. The compressor impeller 4 is fixed to the second end 2*b* of the shaft 2 so that the back surface 41*b* faces the shaft 2. The compressor housing 6 is provided with an inlet 6*a*, a scroll 6*b* communicating with the inlet 6*a*, and an outlet communicating with the scroll 6*b*. The compressor impeller 4 and the compressor housing 6 constitute a compressor 40.

The bearing housing 7 may be joined to the turbine housing 5 and the compressor housing 6. The turbine housing 5 may be joined to the first end of the bearing housing 7 in the axial direction. The compressor housing 6 may be joined to the second end of the bearing housing 7 in the axial direction. The bearing housing 7 accommodates the shaft 2 and a bearing 21 attached to the shaft 2. The shaft 2 is rotatably supported by the bearing housing 7 through the bearing 21.

The turbocharger 1 may further include a disc-shaped seal plate (second wall portion) 8 provided in the inner wall surface of the second end of the bearing housing 7. The seal plate 8 is fitted to, for example, the inner wall surface of the second end of the bearing housing 7. The seal plate 8 is provided so as to face the back surface 41*b* of the main body 41 of the compressor impeller 4. The seal plate 8 is provided with a through-hole into which the shaft 2 is inserted. The seal plate 8 surrounds the shaft 2 in the circumferential direction through a collar 22 fixed to the outer peripheral surface of the shaft 2. A space S in which oil (lubricating oil) circulates is formed on the side opposite to the compressor impeller 4 in the seal plate 8. In some examples a ring member is provided between the collar 22 and the seal plate 8. A space accommodating the compressor impeller 4 and a flow passage of a working fluid F, to be described in additional detail later, are formed by the compressor housing 6, the bearing housing 7, and the seal plate 8.

Figure 2:
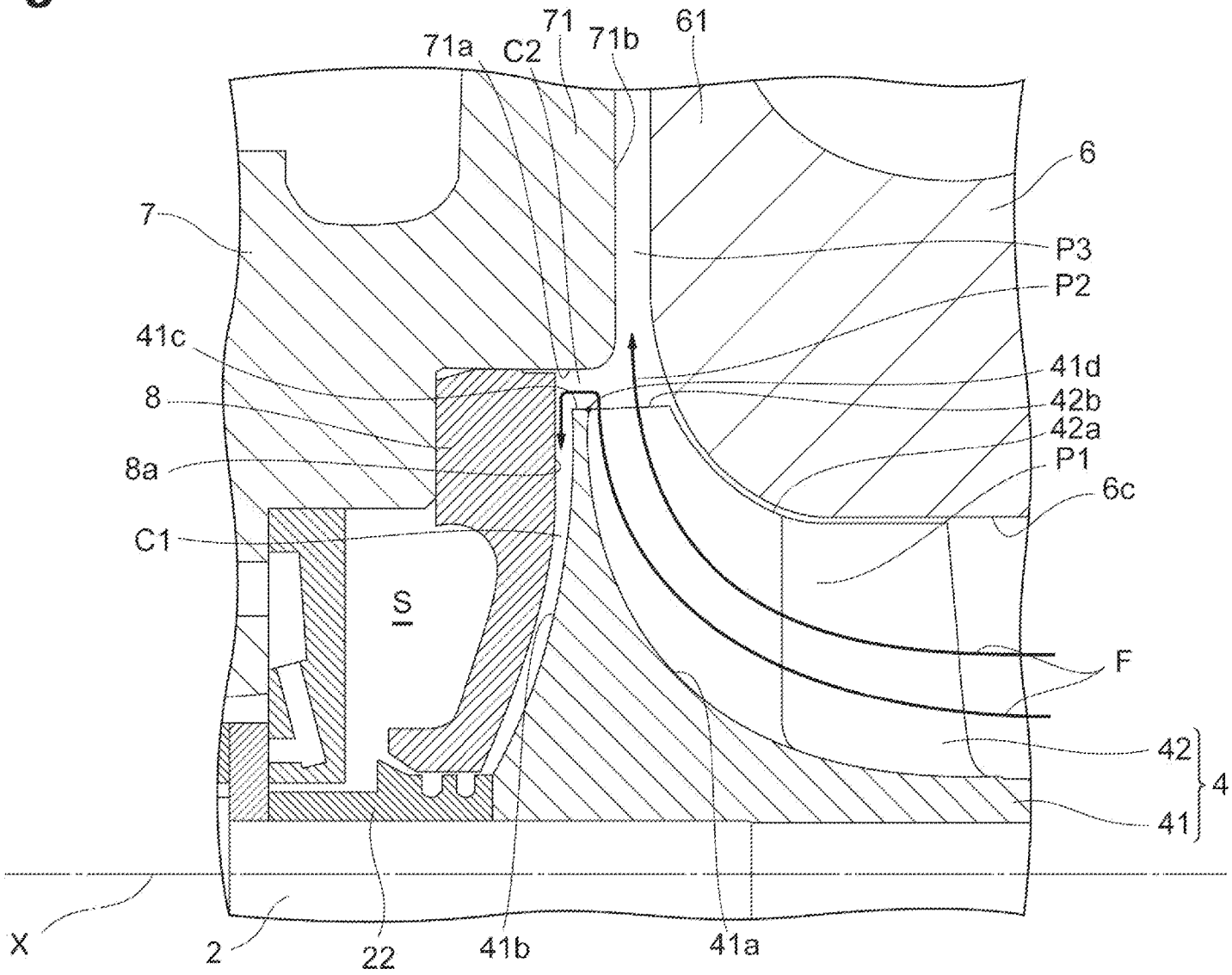
FIG. 2 is a partially enlarged view of FIG. 1.

As illustrated in FIG. 2, the compressor housing 6 may include a first wall surface 6*c*. The first wall surface 6*c* may face the front surface 41*a* of the main body 41 of the compressor impeller 4. The first wall surface 6*c* may extend from the inlet 6*a* in the axial direction and extends toward the scroll 6*b* in the radial direction. The plurality of blades 42 are located between the front surface 41*a* and the first wall surface 6*c*. The first wall surface 6*c* may face the blade 42 with a slight clearance with respect to a tip 42*a* of the blade 42.

The seal plate 8 may include a second wall surface 8*a* which faces the back surface 41*b* of the main body 41 of the compressor impeller 4 and may be formed along the back surface 41*b*. The outer diameter of the seal plate 8 may be larger than the outer diameter of the main body 41. The second wall surface 8*a* may extend to the outside in the radial direction in relation to the side surface 41*c* of the main body 41. The second wall surface 8*a* may face the first wall surface 6*c* at the outside (outer circumferential edge) in the radial direction in relation to the side surface 41*c*. The second wall surface 8*a* may form a first gap C1 together with the back surface 41*b*.

In some examples, the bearing housing 7 may include a protruding wall portion 71 which is provided at the outside in the radial direction in relation to the side surface 41*c* of the main body 41 of the compressor impeller 4 so as to protrude from the second wall surface 8*a* toward the first wall surface 6*c*. The protruding wall portion 71 is, for example, a part of the bearing housing 7. The protruding wall portion 71 may include a third wall surface 71*a* and a fourth wall surface 71*b* connected to the third wall surface 71*a*.

The third wall surface 71*a* may be a part of the inner peripheral surface of the bearing housing 7 provided with the seal plate 8. The third wall surface 71*a* may extend from the second wall surface 8*a* in the axial direction and may face the side surface 41*c*. The third wall surface 71*a* may face the side surface 41*c* over the entire circumference of the side surface 41*c*. The third wall surface 71*a* may be formed by one inner peripheral surface. For example, the third wall surface 71*a* may smoothly extend from the second wall surface 8*a* in the axial direction. The third wall surface 71*a* may further extends toward the first wall surface 6*c* in the axial direction from a connection portion 41*d* which connects the front surface 41*a* and the side surface 41*c*. For example, the third wall surface 71*a* may face the side surface 41*c* of the main body 41 and the rear edge (trailing edge) 42*b* of the blade 42 in the radial direction. The third wall surface 71*a* may form a second gap C2 along with the side surface 41*c*.

The fourth wall surface 71*b* may be connected to the side opposite to the second wall surface 8*a* in the third wall surface 71*a*. The fourth wall surface 71*b* may extend in the radial direction. The fourth wall surface 71*b* may face the first wall surface 6*c*. The fourth wall surface 71*b* may be smoothly continuous to the inner wall surface of the compressor housing 6 forming the scroll 6*b* (see FIG. 1). A connection portion between the fourth wall surface 71*b* and the inner wall surface forming the scroll 6*b* may be flush. In some examples a connection portion between the third wall surface 71*a* and the fourth wall surface 71*b* may be chamfered or deburred.

In some examples, the axial distance (step amount) between the fourth wall surface 71*b* and the connection portion 41*d*, that is, the axial height of the third wall surface 71*a* with respect to the connection portion 41*d* (the height of the portion further extending toward the first wall surface 6*c* from the connection portion 41*d*) may be, for example, 1/20 or more of the length of the trailing edge 42*b* of the blade 42. The step amount may be preferably about 1/10 of the length of the trailing edge 42*b* of the blade 42. The step amount can be freely set according to the specifications and demands of the turbocharger 1.

in some examples, the flow passage where the working fluid (for example, air) F flows is formed by the first wall surface 6*c* of the compressor housing 6, the front surface 41*a* of the main body 41, the second wall surface 8*a* of the seal plate 8, and the fourth wall surface 71*b* of the protruding wall portion 71. For example, the first wall surface 6*c* forms a suction flow passage (flow passage) P1 where the working fluid F flows together with the front surface 41*a* of the main body 41. The first wall surface 6*c* forms an intermediate flow passage P2 communicating with the downstream side of the suction flow passage P1 in the flow direction of the working fluid F together with the second wall surface 8*a* of the seal plate 8. The first wall surface 6*c* forms a diffuser P3 communicating with the downstream side of the intermediate flow passage P2 in the flow direction of the working fluid F together with the fourth wall surface 71*b* of the protruding wall portion 71.

The scroll 6*b* is connected to the downstream side of the diffuser P3 in the flow direction of the working fluid F. In some examples, the turbocharger 1 includes the diffuser P3 and the scroll 6*b* communicating with the suction flow passage P1. Additionally, the intermediate flow passage P2 includes the second gap C2. Further, the suction flow passage P1 and the first gap C1 are connected to each other by the intermediate flow passage P2 including the second gap C2. Accordingly, the second gap C2 fluidly couples the suction flow passage P1 with the first gap C1.

The compressor housing 6 may include an annular overhang wall portion 61. The diffuser P3 is a flow passage which is formed between the surface of the overhang wall portion 61 (a portion extending in the radial direction of the first wall surface 6*c*) and the fourth wall surface 71*b*. The surface of the overhang wall portion 61 and the fourth wall surface 71*b* respectively extend in the radial direction and the circumferential direction and are substantially orthogonal to the rotation axis X. The diffuser P3 may be formed in the periphery (for example, the downstream side) of the compressor impeller 4 and extends in the radial direction and the circumferential direction. The starting end (inlet) of the diffuser P3 may be the third wall surface 71*a*. The terminating end (outlet) of the diffuser P3 may be a front end of the overhang wall portion 61.

In some examples turbochargers 1, the working fluid F may be compressed as follows. An exhaust gas which is discharged from an internal combustion engine flows from the inlet of the turbine 30 into the scroll 5*a* to rotate the turbine impeller 3 and then flows from the outlet 5*b* to the outside. When the compressor impeller 4 rotates with the rotation of the turbine impeller 3 and the shaft 2, the working fluid F may be sucked from the inlet 6*a* of the compressor 40 into the compressor housing 6 and sequentially passes through the suction flow passage P1, the intermediate flow passage P2, the diffuser P3, and the scroll 6*b* to be compressed. The compressed working fluid F is supplied to the intake side of the internal combustion engine.

When the compressor impeller 4 rotates around the rotation axis X, the working fluid F flows through the suction flow passage P1 to be compressed. At this time, a negative pressure may be formed in the first gap C1 in some cases. Accordingly, oil circulating in the space S may leak from a gap between the seal plate 8 and the collar 22 to the first gap C1 due to the suction force generated by the negative pressure, so that so-called oil leakage occurs. In some examples, the turbocharger 1 may include the protruding wall portion 71 which is provided at the outside in the radial direction in relation to the side surface 41*c* of the compressor impeller 4 so as to protrude from the second wall surface 8*a* toward the first wall surface 6*c*. The protruding wall portion 71 may include the third wall surface 71*a* which extends from the second wall surface 8*a* in the axial direction and faces the side surface 41*c* of the compressor impeller 4. The third wall surface 71*a* may further extends toward the first wall surface 6*c* in the axial direction from the connection portion 41*d* which connects the front surface 41*a* and the side surface 41*c*. The third wall surface 71*a* may form the second gap C2 which fluidly couples the suction flow passage P1 with the first gap C1 together with a side surface 41*c*. For this reason, a part of the working fluid F flowing through the suction flow passage P1 along the front surface 41*a* and passing through the intermediate flow passage P2 may collide with the third wall surface 71*a* and flows to the first gap C1 through the second gap C2. Accordingly, a negative pressure may be prevented from being formed in the first gap C1 on the side of the back surface 41*b* of the compressor impeller 4 and oil may be prevented from being sucked to the first gap C1 due to the negative pressure. Thus, the turbocharger 1 may prevent oil leakage.

In some examples, since the third wall surface 71*a* is formed by one inner peripheral surface, a part of the working fluid F flowing through the suction flow passage P1 along the front surface 41*a* and passing through the intermediate flow passage P2 may collide with the third wall surface 71*a* and smoothly flows to the first gap C1 through the second gap C2. Accordingly, a negative pressure may be reliably prevented from being formed in the first gap C1.

The turbocharger 1 includes the diffuser P3 and the scroll 6*b* communicating with the suction flow passage P1. The protruding wall portion 71 may include the fourth wall surface 71*b* which is connected to the side opposite to the second wall surface 8*a* in the third wall surface 71*a* and may face the first wall surface 6*c*. The fourth wall surface 71*b* may extend in the radial direction to form the diffuser P3 together with the first wall surface 6*c* and is smoothly continuous to the inner wall surface forming the scroll 6*b*. In some examples, even in the turbocharger 1 with the protruding wall portion 71, desired compression efficiency can be obtained without deteriorating compression efficiency.

It is to be understood that not all aspects, advantages and features described herein may necessarily be achieved by, or included in, any one particular example. Indeed, having described and illustrated various examples herein, it should be apparent that other examples may be modified in arrangement and detail.

The inner diameter of the third wall surface 71*a* may be constant or changed in the axial direction. For example, when the connection portion between the third wall surface 71*a* and the fourth wall surface 71*b* is chamfered or deburred, the inner diameter of the third wall surface 71*a* can be changed.

In some examples, the protruding wall portion 71 is a part of the bearing housing 7, but in other examples the protruding wall portion 71 may be provided separately from the bearing housing 7. The protruding wall portion 71 is, for example, an annular plate and may be bonded to the bearing housing 7. Further, the protruding wall portion 71 may be integrally formed with the seal plate 8. Accordingly, the protruding wall portion 71 may be a part of the seal plate 8.

Figure 3:
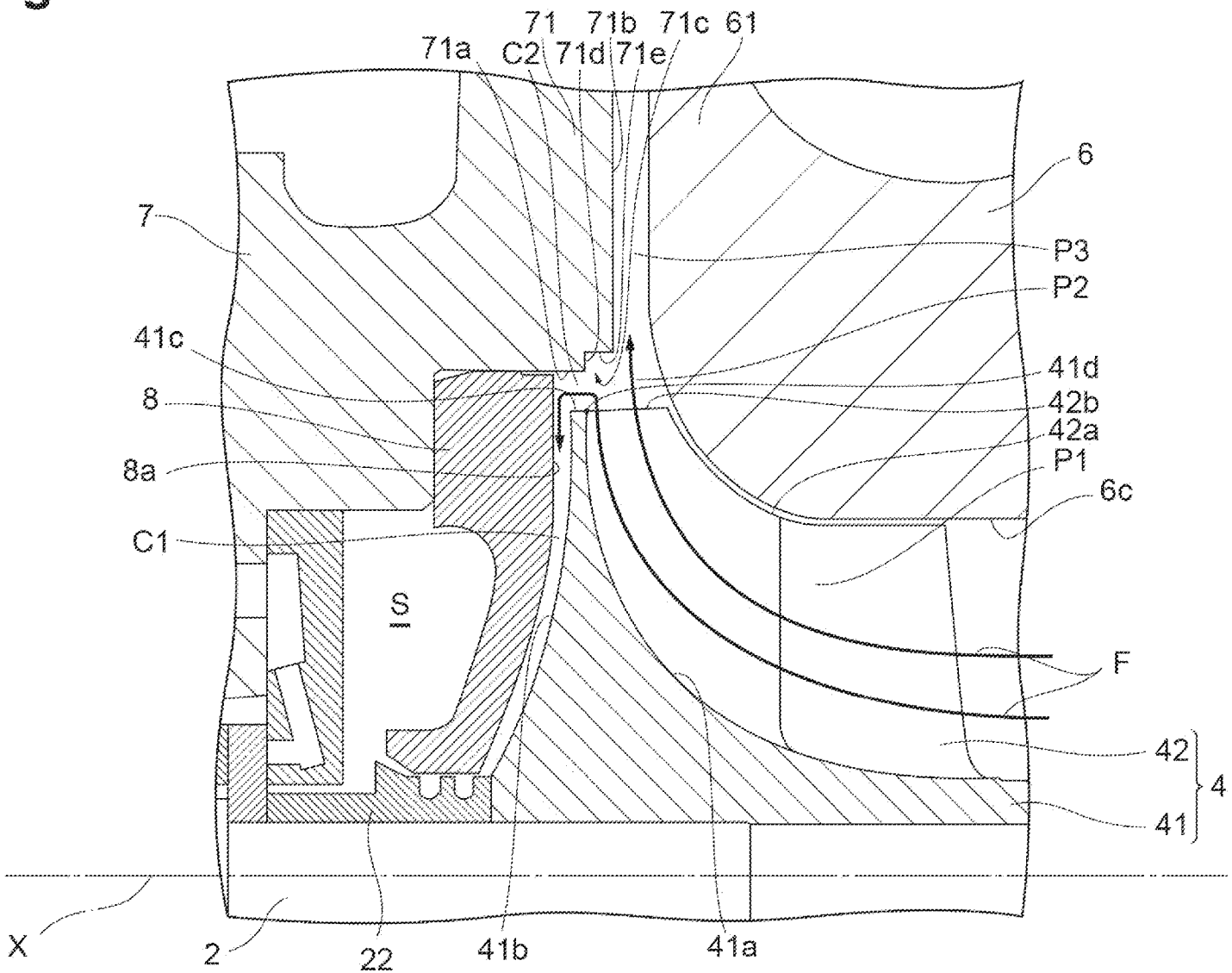
FIG. 3 is a diagram illustrating a third wall surface of a centrifugal compressor of a modified example.

As illustrated in FIG. 3, a step portion 71*c* is formed at an intersection of the third wall surface 71*a* and the fourth wall surface 71*b*. The step portion 71*c* includes a first inner peripheral surface 71*d* and a second inner peripheral surface (recessed inner peripheral surface) 71*e*. The first inner peripheral surface 71*d* faces in the axial direction. The second inner peripheral surface 71*e* faces in the radial direction and enlarges the second gap C2 in the radial direction. The step portion 71*c* is recessed from the third wall surface 71*a* in the radial direction and is recessed from the fourth wall surface 71*b* in the axial direction. The inner diameter of the second inner peripheral surface 71*e* is larger than the inner diameter of the third wall surface 71*a*. Accordingly, the third wall surface 71*a* may have a step, and the degree of freedom in designing the protruding wall portion 71 may be improved.

An example has been described such that the fourth wall surface 71*b* is smoothly continuous to the inner wall surface forming the scroll 6*b*, but the fourth wall surface 71*b* may not be smoothly continuous to the inner wall surface forming the scroll 6*b*.

We claim all modifications and variations coming within the spirit and scope of the subject matter claimed herein.

We claim:

1. A centrifugal compressor comprising: an impeller which includes a main body including a front surface and a back surface located on opposite sides of the main body in an axial direction of the impeller, the main body further including a side surface which connects the front surface and the side surface;

a first wall portion which includes a first wall surface facing the front surface of the impeller;

a flow passage for a working fluid, the flow passage formed between the first wall surface and the front surface of the impeller;

a second wall portion which includes a second wall surface facing the back surface of the impeller;

a first gap formed between the second wall surface and the back surface of the impeller in the axial direction;

a protruding wall portion which is spaced apart from the side surface in a radial direction of the impeller and includes a third wall surface extending from the second wall surface toward the first wall surface in the axial direction and facing the side surface of the impeller, the protruding wall portion further including a fourth wall surface extending in the radial direction and facing the first wall surface;

a second gap formed between the third wall surface and the side surface of the impeller in the radial direction, the second gap fluidly coupling the flow passage with the first gap;

a step portion formed at an intersection of the third wall surface and the fourth wall surface, the step portion including a recessed inner peripheral surface that enlarges the second gap in the radial direction; and a seal plate including the second wall surface, the seal plate forming a seal against the third wall surface of the protruding wall portion so as to direct the working fluid from the second gap into the first gap.

2. The centrifugal compressor according to claim 1, wherein the step portion is recessed from the third wall surface in the radial direction and is recessed from the fourth wall surface in the axial direction.

3. The centrifugal compressor according to claim 2, wherein the step portion forms a notched corner of the protruding wall portion.

4. The centrifugal compressor according to claim 1, wherein the step portion includes a first inner peripheral surface facing in the axial direction, and the recessed inner peripheral surface forms a second inner peripheral surface facing in the radial direction, and wherein the second inner peripheral surface is spaced further away from the side surface of the impeller than the third wall surface in the radial direction.

5. The centrifugal compressor according to claim 4, wherein the first inner peripheral surface is spaced further away from the first wall surface than the fourth wall surface in the axial direction.

6. The centrifugal compressor according to claim 1, further comprising:

a diffuser formed between the fourth wall surface and the first wall surface and extending in the radial direction, an inner surface of the diffuser deviating from the radial direction in a smooth and continuous manner to form a scroll, the diffuser fluidly coupling the scroll to the flow passage.

7. The centrifugal compressor according to claim 1, wherein the seal plate separates the second gap from a space containing lubricating oil, the seal plate configured to prohibit leakage of the lubricating oil into the working fluid due to a negative pressure formed within the first gap.

* * * * *